US005722133A

United States Patent [19]

Farris et al.

[11] Patent Number: 5,722,133

[45] Date of Patent: Mar. 3, 1998

[54] COMBINATION BURIAL VAULT AND CASKET HAVING A SEALED INTERIOR

[76] Inventors: David W. Farris, 203 High Creek Dr., Roswell, Ga. 30076; Jimmy D. Field, 1078 Dover Way, Norcross, Ga. 30093

[21] Appl. No.: 407,891

[22] Filed: Mar. 21, 1995

Related U.S. Application Data

[63] Continuation-in-part of Ser. No. 327,674, Oct. 21, 1994, abandoned.

[51] Int. Cl.[6] ..... A61G 17/00

[52] U.S. Cl. ..... 27/17; 27/3

[58] Field of Search ..... 27/2, 3, 14, 17, 27/35, DIG. 1

[56] References Cited

U.S. PATENT DOCUMENTS

| | | | |
|---|---|---|---|
| 1,184,125 | 5/1916 | Ponton | 27/17 |
| 2,044,439 | 6/1936 | Mitchell . | |
| 2,213,187 | 9/1940 | Donahey | 27/35 |
| 2,916,797 | 12/1959 | McCombs . | |
| 3,164,880 | 1/1965 | Hotchkiss . | |
| 3,283,386 | 11/1966 | Cenegy | 27/3 |
| 4,237,590 | 12/1980 | Work . | |
| 4,249,289 | 2/1981 | Work . | |
| 4,337,556 | 7/1982 | Winburn et al. . | |
| 4,372,018 | 2/1983 | Miller, IV et al. . | |
| 4,759,104 | 7/1988 | Buerosse . | |
| 4,788,757 | 12/1988 | Bethune et al. . | |
| 5,245,733 | 9/1993 | Goria | 27/35 |

*Primary Examiner*—Kien T. Nguyen

*Attorney, Agent, or Firm*—Shlesinger, Arkwright & Garvey LLP

[57] ABSTRACT

A combination casket and burial vault comprising a lid and base, the base defining an interior, and a seal being disposed between the lid and the base. A substantially horizontally extending drive pin attaches the lid to the base without extending into the interior of the base. It is contemplated that one or more of the lid and base will include a composite material.

15 Claims, 4 Drawing Sheets

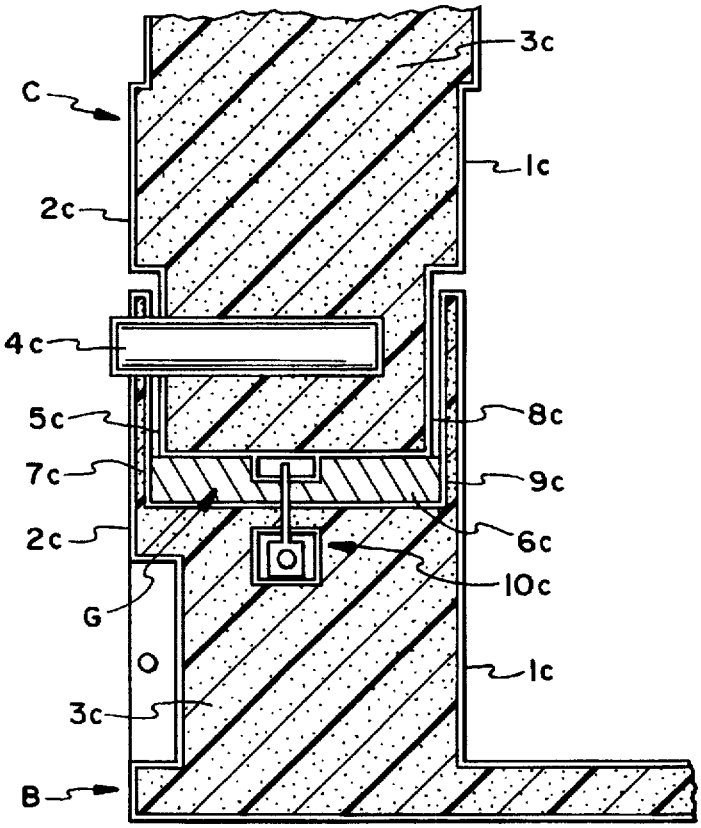
FIG. 3
FIG. 7
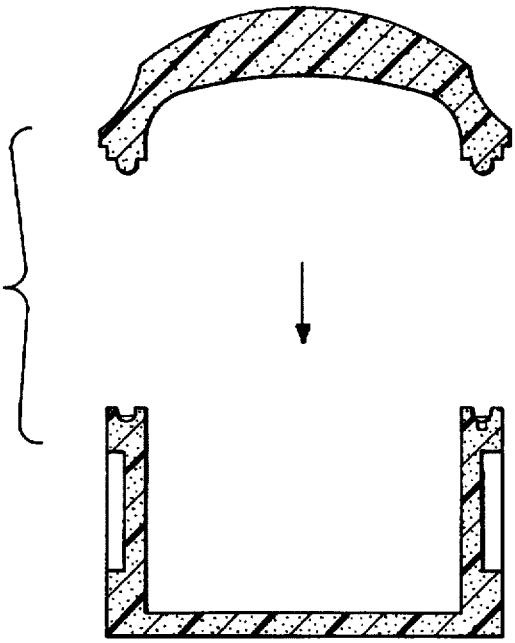

COMBINATION BURIAL VAULT AND CASKET HAVING A SEALED INTERIOR

This application is a CIP of application Ser. No. 08/327,674, filed Oct. 21, 1994, now abandoned and which is incorporated herein by reference.

INTRODUCTION

A combined burial vault and casket for the funeral home and cemetery industry.

The vault/casket system is designed to have the basic appearance as conventional caskets of today.

The purpose for this vault/casket system is that the burial vault and casket are self contained therefore eliminating the vault or can be used as added protection when inserted into a vault and designing the system with a composite material (plastic) that has a longer life span than non treated metal or wood.

The system is made of a composite material with or without vertical columns molded into it at certain intervals to give it strength and non-biodegradability to accomplish the same qualities as a conventional casket and vault, but eliminating the need or cost of a vault.

This can be accomplished with the same, if not more, quality and dignity as systems of today at a more affordable cost to the consumer or funeral director.

The vault/casket systems base (bottom half) and cover have a tongue and groove feature molded into them, so that an o ring, rubber seal or sealant can be applied into the groove of the base. When the cover is closed, there are two different types of locking mechanisms, the locking drive pins or the screw C lock design when in place and the system is buried, the integrity of the system will be established.

The design and the seal, unless physically penetrated, will not allow any moisture or parasites to enter the system for many years (unless breached) once placed into the ground, because there are no voids due to the seal.

The external molding or ornamentation (accessories) will be molded and/or attached onto the vault/casket system.

The internal area of the base has an adjustable bed for the differences in body size which constitute a need for height adjustment. The interior cosmetics will be very similar to the interiors of most standard caskets, to be price effective.

The basic concept is to eliminate the vault, which was designed to eliminate sink holes and to add extra protection to the casket, that are as a rule, required by most perpetual care cemeteries, this concept added additional expense to the consumer on funeral costs, that can now be eliminated with our system (of course the funeral director and cemetery control the costs).

The vault/casket system is comprised of a lid or cover (cut lid or full couch), internal half cover and a base. This system is designed in appearance as that of a present day casket that is purchased from a funeral home except when the vertical structural columns that surround the system are used.

The results are a vault/casket completely sealed, strong to withstand underground pressures or added protection when used with a vault, light weight and offer great advantages for the cremation process with very little residue and mausoleums to prevent leakage.

FIELD OF THE INVENTION

This invention correlates to the containment (construction of a vault/casket) for the remains of a body whether human or animal.

Concrete burial vaults are porous therefore allowing moisture, parasites and other unwanted organisms to enter the vault thus promoting faster deterioration of the casket causing the remains to be contaminated. This vault/casket system is designed to eliminate this problem.

OBJECTS OF THE INVENTION

To keep the same dignity and appearance of the funeral service during viewing, and not changing traditions of any services at the funeral service and at the cemetery.

Vault and casket are self contained (no burial vault) which is constructed to withstand pressure from the forces underground.

Eliminating the burial vault means a small grave plot which means more grave plots per acre giving the cemetery additional profit.

The vault/casket system is built as a molded unit which is where it gets its strength to eliminate the burial vault.

The vault/casket system is molded with a composite material that does not deteriorate underground for an indefinite period of time, which makes it far superior to untreated metal and wood caskets.

The system is locked with drive pins or a screw C lock design, which would make the vault/casket system very difficult to reopen under normal circumstances. This is incorporated into the system to help reduce unauthorized entry.

Air tight integrity makes the vault/casket system a superior unit because the system is able to keep out moisture, parasites and other unwanted organisms by incorporating an o ring seal, rubber seal or sealant between the base and cover.

Embarrassing leakage problems are eliminated because of the internal one piece molded base (bottom casket half) which is superb for mausoleums.

The vault/casket system virtually eliminates sink holes because of its strength and longevity to ward off deterioration.

Carrying handles or rods can be incorporated or attached onto the system to make ease of handling and manual transportation.

Being of a composite material this system is very useful to cremation because of the low temperature needed to burn the composite materials with a minimum amount of residue. The construction can be minimized internally to reduce costs because the vault/casket does not have to be structurally strong for cremation, compared to being buried underground. Plus less materials used.

Being of a composite material this system is very useful to mausoleums because of the containment of fluids. The construction can be minimized internally to reduce costs because the vault/casket does not have to be structurally strong for mausoleum use, compared to being buried underground. Plus less materials used.

The vault/casket system is light weight which makes it manually transportable.

The finish can be varied by molding different surfaces onto the outer wall of the vault/casket (leather grain, shot peened, wood, smooth and many other textured surfaces). The finish can be varied by applying paint to resemble a metallic or painted appearance.

A two way air relief valve can be installed for the variances of external air pressure if needed.

BRIEF DESCRIPTION OF THE DRAWINGS

FIG. 3 shows the function of the drive pin 4C and screw C lock design 10c.

FIGS. 5–7 show additional features of the present invention.

DESCRIPTION OF DRAWINGS

FIG. 1

Figure 1:
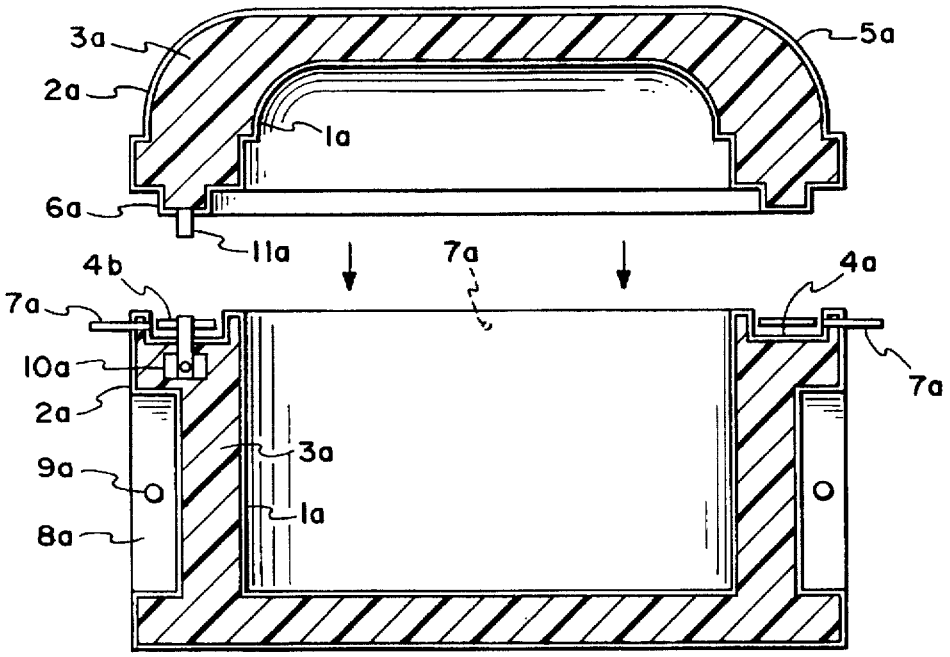
FIG. 1 shows the vault/casket system of the present invention in narrow end cross section
Figure 2:
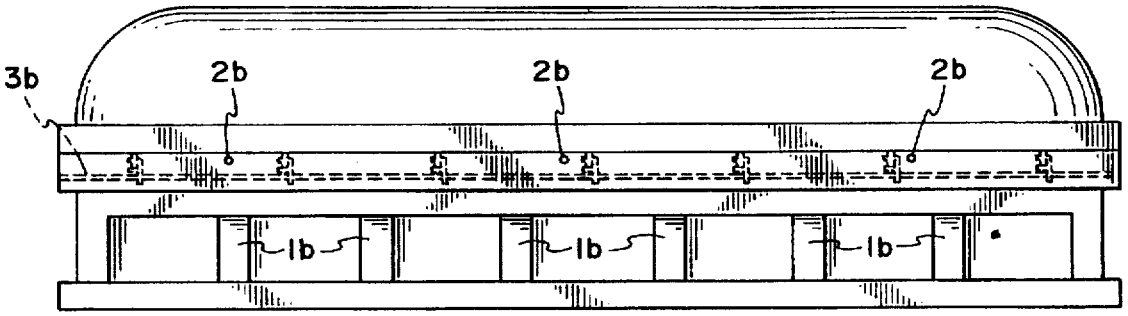
FIG. 2 shows the base and cover in side view.

FIG. 1 shows the vault/casket system which uses a rotational molded process of composite material (polyethylene, etc.) that is composed of an inner wall and an outer wall which is foam filled (polyurethane, etc.) in between the two side walls, bottom, end walls and cover for strength and lightweight (narrow end cross section view).

An inner wall 1a is composed of a composite material (polyethylene, etc.).

An outer wall 2a is composed of a composite material (polyethylene, etc.).

In between the two walls is a composite material foam fill 3a (polyurethane, etc.).

Or the vault/casket system uses a rim spray process of composite material that is composed of an inner wall and outer walls which is foam filled in between the side walls, bottom, end walls and cover for strength and light weight (narrow end cross section view).

Inner wall 1a is composed of a composite material that is applied by a spray process.

Outer wall 2a is composed of a composite material that is applied by a spray process.

Between the outer wall and the foam is a composite barrier material wall applied by a spray process.

In between the barrier material and the inner wall is a composite foam fill material that is applied by a spray process or pressurized fill.

These four compositions along with structural columns when needed and curves is where the vault/casket gets its structural strength. Any one or more of these processes can be eliminated to change the strength of the vault/casket.

A groove 4a incorporated around the top portion of the base that mates with the cover is where a seal or sealant 4b is to go for an air tight seal. The groove area on the base is where the outer walls and inner wall mate (the outer wall groove on top and the inner wall groove below) together and are sealed chemically or by a seal.

A cover 5a is also composed of inner and outer walls that are foam filled in between the walls for strength and lightweight by either of the four processes above.

A tongue 6a incorporated around the bottom portion of cover 5a that mates with the base is where the seal or sealant 4b is to be positioned for the air tight integrity of the system.

Cover locking 7a drive pins are spaced around the vault/casket to secure the cover to the base after final viewing. The pins are driven through the base and cover but not into the inner wall so as not to interfere with the air tight integrity of the system. All this is done after the seal or sealant has been positioned or applied.

Structural columns 8a for strength may be spaced around the system (amount of columns vary with vault/casket styles).

Handles or rods 9a may be incorporated into the columns 8a for manual transport.

Figure 4:
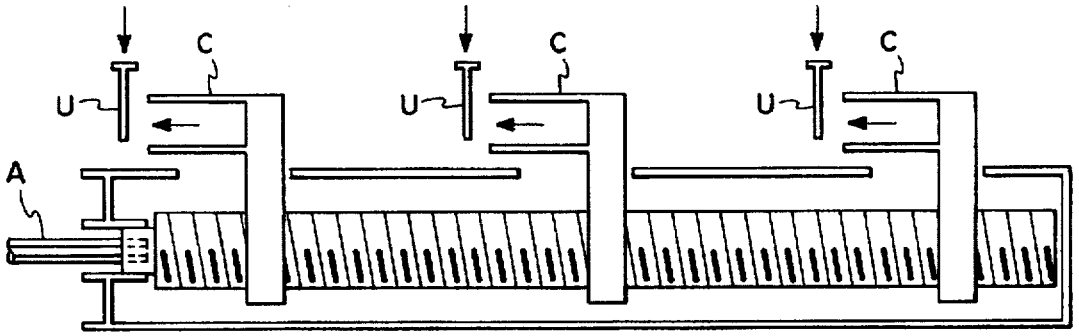
FIG. 4 shows the alternative screw C lock design.
Figure 5B:
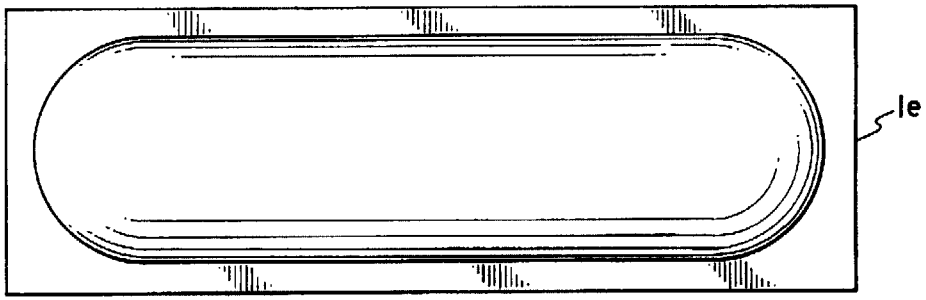
Figure 5D:
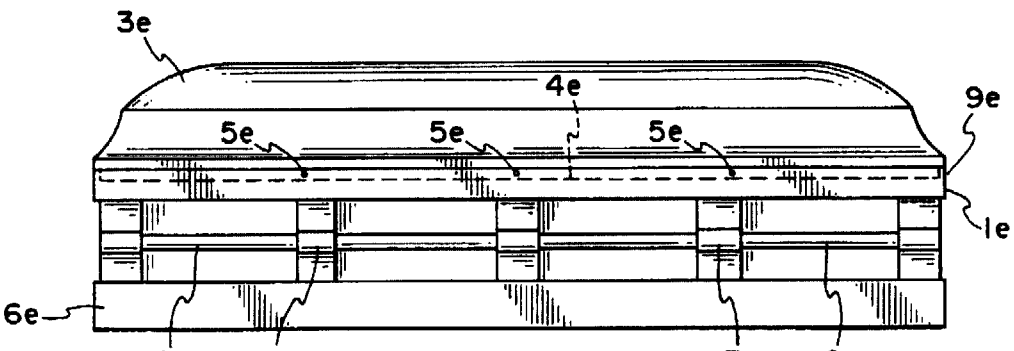
Figure 5A:
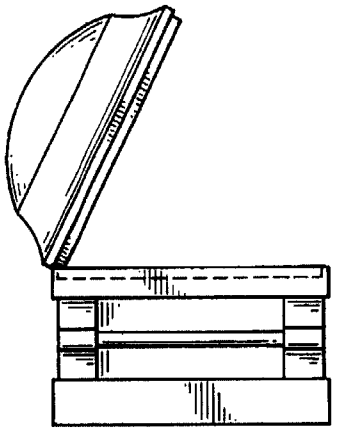
Figure 5C:
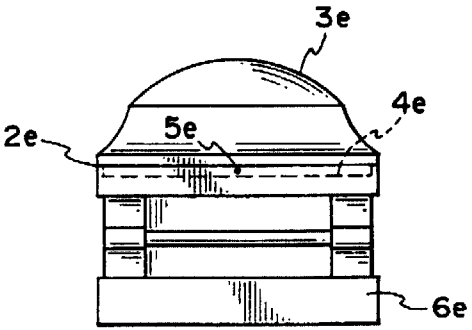
Figure 6A:
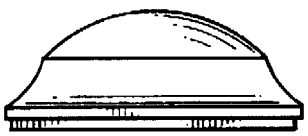
Figure 6B:
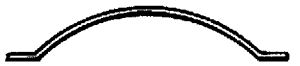
Figure 6C:
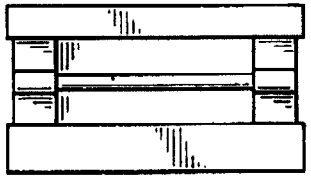
Figure 6D:
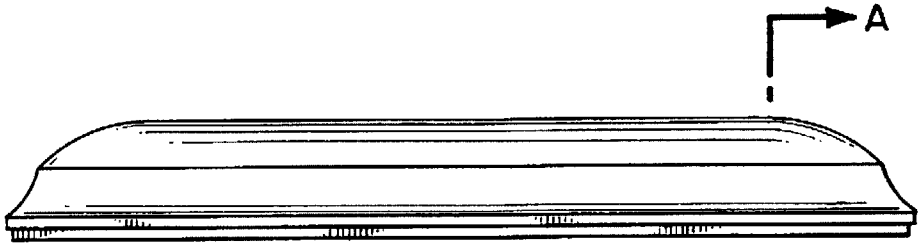
Figure 6E:
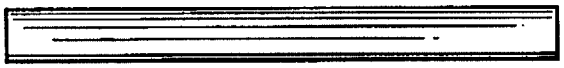
Figure 6F:
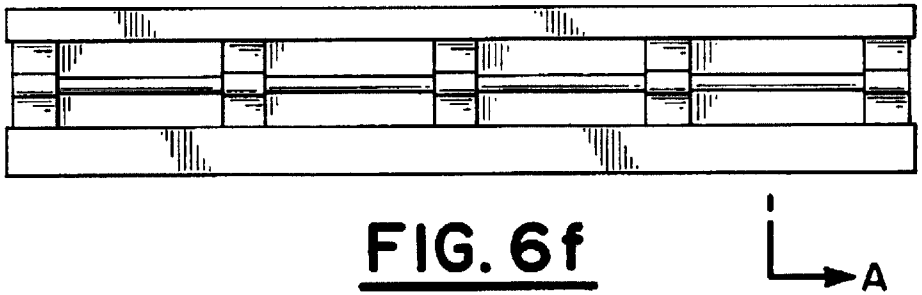

Position for screw C lock design (screw part and C parts 10a); explanation of screw C lock design is under FIG. 4 section.

Position for screw C lock design (U parts 11a); explanation of screw C lock design is under FIG. 4 section.

FIG. 2

The base and cover (side view).

Structural columns 1b may be used for strength and handles or rods to be incorporated into or through the columns for manual transport capabilities. Number of columns may vary with different casket styles.

Drive pins 2b are driven into place by means of a mallet to lock the cover onto the base after the final viewing of the body.

Position for the screw C lock 3b, which extends from one end to other end.

Hinges are molded or fastened to the cover and base but fasteners are not damaging the integrity of the system.

Corners will be square, round or a combination.

FIG. 3

FIG. 3 is solely for the purpose of showing the function of the drive pin 4c (locking device fastener) and screw C lock design 10c.

Explanation: drive pin 4c, a dowel or pin (metal) encased with a outer covering (plastic or metal). The appearance and function of the drive pin 4c is like that of a pop rivet. The function is that the casing with the pin extending out away from the vault/casket is inserted into the drive pin hole (which extends through the outer walls 7c of base groove, over the seal and into the outer walls 5c of the tongue cover but not extending into the inner wall 8c of the tongue cover) of the vault/casket when the seal and vault/casket cover is closed onto the base. The pin 4c is then driven into the casing flush with the casing and vault/casket side, therefore the casing and pin 4c lock the base and cover together.

Inner wall 1c of cover C forms the tongue of the cover that rests in the groove G of base.

Outer walls 2c of cover C form the tongue of cover C that rests in the groove G of base.

Foam fill 3c is injected or sprayed between the two walls of the cover and base B and contributes to the structural strength of the system.

Drive pin 4c when the cover C is closed onto base B, the pin 4c is inserted into the drive pin hole that inserts through the outer walls 7c of base groove, outer walls 5c of tongue cover, into foam fill 3c to accomplish a locked position.

Outer walls 5c of tongue cover form with inner wall 8c of tongue cover to form tongue that rests onto seal 6c, into groove of base.

Seal 6c rests between tongue of groove of base and cover to form airtight seal.

Outer walls 7c of base groove form with inner wall 9c of base groove to form groove that seal 6c rests on.

Inner wall 8c of tongue cover form with outer walls of tongue cover 5c to form tongue that rest onto seal 6c, into groove G of base.

Inner wall 9c of the base groove form with outer walls 7c of base groove to form groove that seal 6c rests onto.

Screw C lock 10c design is located in the base B and the cover C.

FIG. 4

FIG. 4 is solely for the purpose of showing the function of the alternative screw C lock design.

Explanation: When the lid is closed onto the base the threaded rod (screw) (located in the base) is turned by allen wrench A and the C-shaped part will move towards the stationary U-shaped part U (located in the lid). The two then intersect to form a lock between the casket cover and base. The screw C lock design runs from one end to the other end of the base of the casket with the C-shaped parts C protruding above the groove in the base so as to intersect with the U-shaped parts U protruding down from the tongue of the cover.

SCREW C LOCK MECHANISM

When the threaded rod (located in the base) is turned by an allen wrench the C-shaped material C will move towards the stationary U-shaped material U (located in the lid). The two then intersect to form a lock between a casket lid or cover and base.

FIGURES 5–7

FIG. 5 illustrates additional features of our invention, in four views thereof. Beginning with the upper left figure, and proceeding clockwise, FIG. 5*a* illustrates an open view of the casket-vault, FIG. 5*b* a top view, FIG. 5*d* a side view, and FIG. 5*c* an end view.

FIGS. 5–7 show additional views of the invention. Turning to FIGS. 5*b* and 5*d*, in particular, a name plate 1*e* is for identification purposes to identify the remains of a body whether human or animal so the vault/casket or casket does not have to be penetrated once sealed or locked closed. The reason for this is that in the past, caskets or body remains during floods or relocation were being lost because the casket had deteriorated and the remains were lost or unidentifiable. (See FIGS. 5*b* and 5*d*, for example). The name plate 1*e* is positioned on the outside end of the vault/casket or casket.

The name plate will be made of a plastic material and shaped (approx. 2⅛"×3⅜") with the letters protruding outward in case the colors wear off the letters then the letters will still be identifiable. It will resemble a plastic credit card.

The name plate 1*e* will be attached to the exterior of the vault/casket or casket by means of using push pins also made of plastic that once attached by the push pins it will not be able to be removed unless forced.

Note also hinge 2*e* between cover 3*e* and the base. Also, seal 4*e*, lock pin(s) 5*e*, bed 6*e*, bushing 7*e* carrying handle 8*e*, and screw lock mechanism 9*e*.

FIG. 6 shows additional views of cover and base. Beginning in the upper left figure: and an end view of the cover (FIG. 6*a*) and an internal cover panel (FIG. 6*b*) spaced therefrom for clarity are shown, a side view of the cover (FIG. 6*d*) is shown, a side view of internal cover panel (FIG. 6*e*) a side view of the base (FIG. 6F), and then an end view of the base (FIG. 6*c*) is shown.

FIG. 7 is a detail of FIG. 6, taken along Section A—A therein.

An important feature of our invention is that drive pins (such as shown in FIG. 3) are horizontally driven into the side of the cover and base (partially through the tongue-and-groove system). Our inventive system is a complete system and does not use a removable casket.

It is likewise anticipated that our system will have hinges attaching the cover and base together.

It is another feature of our invention that our system is a self-contained casket/vault system which always maintains the appearance of a casket, unlike prior art devices in which false caskets are removed.

It is likewise contemplated that our system uses inner and outer walls that do not have connecting junctions fusing the walls together. Preferably our system uses a polyurethane foam (as opposed to conventional concrete) that is injected or sprayed into the cover and base at the manufacturing plant (not at the grave site) that makes our system lightweight for transporting thereof.

It is yet another feature of our invention that no interlocking ribs are required for the inner and outer walls to intersect. In a preferred embodiment of our invention, a one piece base and a one piece cover are provided. Our inventive system has simply two pieces which are joined together by hinges, preferably at the manufacturing plant, and which do not require the use of a reusable false casket.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

What we claim is:

1. A combination burial vault and casket, comprising:

a) a base, said base having a substantially vertical wall defining an interior;

b) a free edge extending around an upper portion of said wall;

c) a lid, said lid having a free surface configured for mating with said free edge;

d) said lid extending transversely to said wall when said free surface mates with said free edge; and e) a substantially horizontally extending drive pin attaching said transversely extending lid to said substantially vertical wall without extending into said interior of said base;

f) said free edge of said wall and said free surface of said lid jointly define a tongue-and-groove connection.

2. A combination burial vault and casket as defined in claim 1, wherein:

a) said substantially vertical wall includes two long vertical walls and two short vertical walls;

b) said long vertical walls have a length longer than said short vertical walls in a substantial horizontal direction;

c) said long and short vertical walls define said interior to be a substantially horizontally extending interior configured for receiving a substantially horizontally extending corpse.

3. A combination burial vault and casket as defined in claim 2, wherein:

a) said drive pin includes an elongated horizontally extending shaft.

4. A combination burial vault and casket as defined in claim 3, wherein:

a) said elongated shaft of said drive pin is configured for sustaining forces applied transversely to the length of said elongated shaft.

5. A combination burial vault and casket as defined in claim 1, wherein:

a) said drive pin extends through a tongue of said tongue-and-groove connection.

6. A combination burial vault and casket as defined in claim 1, wherein:

a) said drive pin includes an elongated horizontally extending shaft.

7. A combination burial vault and casket as defined in claim 6, wherein:

a) said free edge of said wall and said free surface of said lid jointly define a tongue-and-groove connection; and b) said drive pin extends through a tongue of said tongue-and-groove connection.

8. A combination burial vault and casket as defined in claim 1, wherein:

a) a name plate of synthetic material is attached to one of said base and lid.

9. A combination burial vault and casket as defined in claim 8, wherein:

a) written identifying information is disposed on said nameplate and said identifying information protrudes outwardly of said nameplate.

10. A combination burial vault and casket as defined in claim 9, wherein:

a) a synthetic push pin attaches said name plate to said one of said base and said lid.

11. A combination burial vault and casket as defined in claim 1, wherein:

a) a hinge is disposed between said lid and said base and hingedly attaches said lid to said base.

12. A combination burial vault and casket, comprising:

a) a base, said base having a substantially vertical wall defining an interior;

b) a free edge extending around an upper portion of said wall;

c) a lid, said lid having a free surface configured for mating with said free edge;

d) said lid extending transversely to said wall when said free surface mates with said free edge;

e) a substantially horizontally extending drive pin attaching said transversely extending lid to said substantially vertical wall without extending into said interior of said base; and f) said substantially vertical wall including an inner wall and an outer wall.

13. A combination burial vault and casket as defined in claim 12, wherein:

a) said inner and outer wall being polyethylene.

14. A combination burial vault and casket as defined in claim 12, wherein:

a) a foam fill is disposed between said inner and outer walls.

15. A combination burial vault and casket as defined in claim 12 wherein:

a) said foam fill includes polyethylene.

* * * * *